US006902315B2

(12) United States Patent
Hutchinson

(10) Patent No.: US 6,902,315 B2
(45) Date of Patent: Jun. 7, 2005

(54) DEVICES, METHODS AND SYSTEMS FOR MIXING AND STIRRING PAINTS AND THE LIKE

(76) Inventor: Dennis Oliver Hutchinson, P.O. Box 916, Davenport, FL (US) 33836-0916

( * ) Notice: Subject to any disclaimer, the term of this patent is extended or adjusted under 35 U.S.C. 154(b) by 73 days.

(21) Appl. No.: 10/358,542

(22) Filed: Feb. 5, 2003

(65) Prior Publication Data

US 2004/0151060 A1 Aug. 5, 2004

(51) Int. Cl.[7] ..... B01F 7/32

(52) U.S. Cl. ..... 366/343; 366/129; 366/325.8; 416/227 R

(58) Field of Search ..... 366/343, 129, 366/325.4, 325.7, 325.8, 605, 293; 15/230.11; 416/227 R

(56) References Cited

U.S. PATENT DOCUMENTS

| | | | | | |
|---|---|---|---|---|---|
| 2,325,867 | A | * | 8/1943 | Matsakas | 15/230.11 |
| 2,542,491 | A | * | 2/1951 | Engel | 15/230.11 |
| 2,563,049 | A | * | 8/1951 | Liebelt et al. | 15/230.11 |
| 2,591,530 | A | * | 4/1952 | Findley et al. | 401/197 |
| 2,711,748 | A | * | 6/1955 | Barsness | 134/149 |
| 2,913,752 | A | * | 11/1959 | Boyles | 15/230.11 |
| 2,916,755 | A | * | 12/1959 | De Bozzay | 401/197 |
| 3,119,137 | A | * | 1/1964 | Schueler | 15/230.11 |
| 3,436,264 | A | | 4/1969 | Allen | |
| 3,733,645 | A | * | 5/1973 | Seiler | 366/343 |
| 3,892,388 | A | * | 7/1975 | Wass et al. | 366/325.7 |
| 3,925,908 | A | * | 12/1975 | Dunn | 34/58 |
| 4,263,055 | A | | 4/1981 | Permar | |
| 4,311,158 | A | | 1/1982 | Harvey | |
| 4,332,067 | A | * | 6/1982 | Pearce | 15/230.11 |
| 4,545,395 | A | | 10/1985 | Kolb | |
| 4,735,522 | A | * | 4/1988 | Myun-Sik | 15/230.11 |
| 5,122,038 | A | * | 6/1992 | Malkoski | 366/325.7 |
| 5,185,938 | A | * | 2/1993 | Hutt | 34/58 |
| 5,539,948 | A | | 7/1996 | McCauley | |
| 5,626,158 | A | | 5/1997 | Gratopp | |
| 5,870,795 | A | * | 2/1999 | Sizemore | 15/230.11 |
| 5,984,518 | A | * | 11/1999 | King et al. | 366/129 |
| 6,012,473 | A | * | 1/2000 | Koyama | 366/343 |
| 6,088,933 | A | | 7/2000 | Mallalieu | |
| 6,116,255 | A | | 9/2000 | Walter | |
| 6,286,989 | B1 | * | 9/2001 | King | 366/129 |
| 6,325,532 | B1 | * | 12/2001 | King et al. | 366/605 |
| 6,520,672 | B1 | * | 2/2003 | Whitney | 366/605 |

* cited by examiner

*Primary Examiner*—Tony G. Soohoo
(74) *Attorney, Agent, or Firm*—Technoprop Colton LLC

(57) ABSTRACT

Devices, systems and methods for mixing and stirring paints and the like having an axial shaft with a means for moving the liquid mounted on the axial shaft and a cage-like frame surrounding the means for moving the liquid and surrounding at least a portion of the axial shaft, and a combination device for mixing and stirring paints and the like and for holding a roller paint brush cover for cleaning.

29 Claims, 8 Drawing Sheets

DEVICES, METHODS AND SYSTEMS FOR MIXING AND STIRRING PAINTS AND THE LIKE

BACKGROUND OF THE INVENTION

1. Technical Field

The invention generally relates to the field of painting using roller paint brush covers and more specifically relates to the field of removing roller paint brush covers still containing wet paint from the handle framework and removing paint from and cleaning these roller paint brush covers. The invention further relates to methods and systems for handling roller paint brush covers containing wet paint, methods and systems for removing wet paint from roller paint brush covers, and methods and systems for cleaning wet paint from roller paint brush covers. The invention further relates to a devices and combinations of devices that can be used to stir and mix paint, remove roller paint brush covers from the handle framework, remove paint from and clean roller paint brush covers, and methods and systems for accomplishing these actions.

2. Prior Art

Likely the most well-known method of dealing with roller paint brush covers is to grasp the wet roller paint brush cover, pull it off of the handle framework, throw it away, and go out and purchase a new roller paint brush cover for the next painting job. Those that are more adventurous will wash the roller paint brush cover in the appropriate cleaning solution (such as water or soapy water for water-based paints, and suitable other solvents for water-insoluble paints), air dry it, and reuse it for the next painting job. Either way, removing the roller paint brush cover when wet from the handle framework can be a messy adventure, and cleaning the roller paint brush cover for reuse even more so.

Similarly, likely the most well-known method of stirring or mixing paint is either by using a stirring stick, which can be messy, or by vigorously shaking the paint can, which can be difficult to do properly unless you happen to have a can shaker, which can be expensive. Stirrers are known, including powered stirrers and stirrers attached to power drills. However, these stirrers do not have a protective cage surrounding the impellers to prevent damage and injury and to allow stirring proximal to the side of the container.

The economically and/or ecologically minded prefer washing and reusing the roller paint brush cover. For them, several different devices are available. For example, U.S. Pat. No. 3,436,264 to Allen discloses an apparatus for cleaning paint roller covers. The Allen '264 device comprises an expandable spindle for inserting into and holding the roller paint brush cover. The spindle is mounted on a power drill and the roller paint brush cover is rotated within a bag or other disposable device to remove the paint by centrifugal force. However, the Allen '264 device uses an expandable spindle, which adds to the complexity of the device, and does not comprise a device for removing the roller paint brush cover from the handle framework or the spindle, and therefore does not prevent the messes associated with such an operation.

Similarly, U.S. Pat. No. 4,545,395 to Kolb discloses a paint roller apparatus with inherent cleaning capability. The Kolb '395 device is a unitary device that can be used for roller brush painting and, when the painting is finished, cleaning the roller brush. Specifically, the Kolb '395 device comprises a handle and a roller on which a roller paint brush cover is mounted. The roller comprises means for attaching to a power drill such that after painting, the roller can be spun clean. However, the Kolb '395 device is a unitary device, and does not appear to be suitable for the common roller painting apparatus. Further, the Kolb '395 device also does not have a device for removing the roller paint brush cover from the handle.

U.S. Pat. No. 4,263,055 to Permar and U.S. Pat. No. 5,539,948 to McCauley disclose simple devices that can be inserted into the center of a roller paint brush cover and mounted on a power drill for spin cleaning. U.S. Pat. No. 6,116,255 to Walter, U.S. Pat. No. 5,626,158 to Gratopp, and U.S. Pat. No. 4,311,158 disclose stand alone devices for spinning and cleaning roller paint brush covers. U.S. Pat. No. 6,088,933 to Mallalieu discloses a hand-operated spin cleaning device for roller paint brush covers. However, none of these devices combine the spin cleaning device with a device for removing the roller paint brush cover from the handle framework.

Thus it can be seen that there is a need for a simple and economical device, method and system for cleaning roller paint brush covers and for handling the roller paint brush covers during the cleaning process. It can also be seen that there is a need for an improved device for stirring and/or mixing paints, stains and other coatings and liquids. It is to these needs and other related needs that the present invention is directed.

BRIEF SUMMARY OF THE INVENTION

The invention briefly described is a device, method and system for cleaning paint from paint roller brushes. The invention comprises a gripping device for removing a paint roller brush from the handle framework, a holding device for holding the paint roller brush during the paint removing and cleaning process, and a mounting device for connecting the holding device with the paint roller brush to a motor or other motion imparting means. The invention further comprises a device attached to the holding device for stirring and mixing paint.

The gripping device comprises a generally cylindrical tube mounted on a handle. The generally cylindrical tube comprises open ends and can comprise a solid cylindrical wall or a cylindrical wall having an open slot along its length. The open slot can extend along the entire length of the generally cylindrical tube to provide a passageway for a support rod of the handle framework to pass as the roller paint brush cover and the gripping device are moved to remove the roller paint brush cover from the handle framework. The inner diameter of the generally cylindrical tube should be approximately the same as or slightly larger than the outer diameter of the roller paint brush cover. Alternatively, the inner diameter of the generally cylindrical tube can be relatively large so as to be able to accommodate different roller paint brush covers having a wide variety of diameters.

One end, the insertion end, of the gripping device preferably is completely open so as to allow the insertion of the roller paint brush cover. The other end, the tail end, can also be completely open, but optionally can be closed, partially closed, or comprise a tab for contacting and pushing the roller paint brush cover off of the handle framework. The handle is attached to the generally cylindrical tube along the cylindrical wall in such location allowing the user to hold the generally cylindrical tube but not interfering with the open ends of the generally cylindrical tube. Grippers of various diameters can be made for paint roller brushes of various diameters, or a single gripper having a relatively large, or having a variable, diameter can be made for use with several different diameters of roller paint brush covers.

The holding device comprises a cage-like frame similar or identical to the known cage-like frames on which paint roller brushes are mounted for use. The cage-like frame generally is cylindrical in shape, the cylindrical shape being formed by a plurality of wires or rods extending the length of the cylindrical shape. End caps, rings or other devices can be used to hold the plurality of wires or rods together in the generally cylindrical shape. The outer diameter of the holding device preferably is approximately the same as the inner diameter of the paint roller brush such that the paint roller brush can be mounted and held securely on the holding device. Optionally, the holding device can have an outer diameter slightly larger than the inner diameter of the paint roller brush, or can be a flexible or spring-like construction, to increase the holding power.

The mounting device comprises a shaft or rod that is attached securely to and extends axially from the holding device. The mounting device can extend along the entire or partial length of the holding device, in which case it would be positioned as the central axis, or it can be attached at an end of the holding device and extend outwardly and axially from the holding device. In any construction, the mounting device extends a suitable distance outwardly and axially from the holding device so as to mountable in the motor or other motion imparting device.

The motor or other motion imparting device preferably provides rotational motion to the mounting device, and thus to the holding device and any paint roller brush on the holding device. A hand or power drill or other such motor-driven device is suitable.

In use, a house, wall, ceiling or other structure or surface has been painted using a roller paint brush cover, the roller paint brush cover generally remains loaded with some paint. Rather than removing the loaded roller paint brush cover from the handle framework with the hands, gloves or other means that would then become soiled and/or ruined, the user of the invention grasps the handle of the gripping device and slides the gripping device over the loaded roller paint brush cover. Handle frameworks typically have a singe shaped rod extending from a handle and terminating in a roller paint brush cover holding end after bending through a series of curves, thus holding the roller paint brush cover from one end. A typical representation of a handle framework is shown in FIG. 1. The griping device is placed over the loaded roller paint brush cover with the support rod of the handle framework passing through the slot in the generally cylindrical tube. If the gripping device comprises a closed or partially closed end, or a pushing tab, this will assist in pushing the roller paint brush cover off of the handle framework. Alternatively, the gripping means can be structured to hold the roller paint brush cover securely enough to remove the roller paint brush cover from the handle framework without the need for a closed or partially closed end, or a pushing tab.

The user then transfers the loaded roller paint brush cover onto the holding device in generally the opposite manner as the roller paint brush cover was removed from the handle framework. The user slides the roller paint brush cover onto the cage-like structure of the holding device and then removes the gripping device, leaving the roller paint brush cover on the holding device. The holding device either already is mounted on or then is mounted on the motor or motion imparting device. The motor or motion imparting device can be a power drill or a similar device.

The loaded roller paint brush cover then is placed into a bucket or other container of water or soapy water (for water soluble paints) or other solvent (for water insoluble paints) and the motor or other motion imparting device activated. The roller paint brush cover is spun around in the cleaning solution for a period of time sufficient to remove the paint from the roller paint brush cover. This step can be repeated any number of times to achieve the level of cleaning desired. The roller paint brush cover then can be spun in a bucket of clean water to rinse cleaning solution from the roller paint brush cover. After the roller paint brush cover has been cleaned, the roller paint brush cover then can be spun in an empty bucket, cylinder or other structure, or in the open, to remove any excess water or cleaning solution and to spin dry the roller paint brush cover. The roller paint brush cover now has been restored to a clean or cleaner state for reuse.

The invention also includes a device for stirring and/or mixing paints, stains and other coatings and fluids. The stirring device is a modification of the holding device and comprises a cage-like frame similar or identical to the known cage-like frames on which paint roller brushes are mounted for use. The cage-like frame generally is cylindrical in shape, the cylindrical shape being formed by a plurality of wires or rods extending the length of the cylindrical shape. End caps, rings or other devices can be used to hold the plurality of wires or rods together in the generally cylindrical shape. The stirring device has rod as the central axis, which generally is a continuation of the shaft or rod of the mounting device. The stirring device can be one or more impellers or other suitable mixing component. In use, the stirring device is mounted via the mounting device on a motor or other motion imparting device and the stirring device is placed in the liquid to be stirred or mixed. The motor or other motion imparting device is activated and the stirring device acts on the liquid. The cage-like frame also can assist in stirring and/or mixing the liquid, and further allows stirring and/or mixing right up to the side of the container as the cage-like frame can contact the container without damaging the container.

The invention also is a system for cleaning roller paint brush covers comprising the gripping device, the holding device and the motor or motion imparting device, and a method for cleaning roller paint brush covers using the devices and systems of the invention. The features and advantages of the present invention will become even more apparent to those of ordinary skill in the art when the following detailed description of the preferred embodiments is read in conjunction with the appended figures in which like reference numerals designate like parts throughout the several views.

DETAILED DESCRIPTION OF THE PREFERRED EMBODIMENTS

Figure 13:
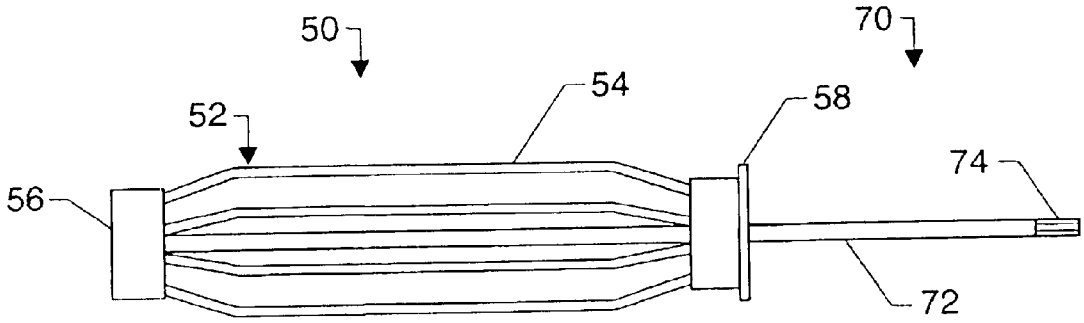
FIG. 13 is a side view of one embodiment of a combined holding device and mounting device of the present invention.
Figure 14:
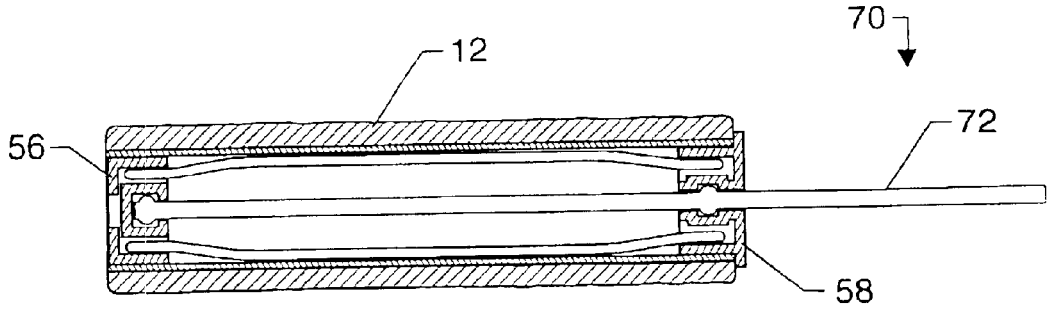
FIG. 14 is a sectional side view of the embodiment of the combined holding device and mounting device as shown in FIG. 13 with a roller paint brush cover placed thereon.
Figure 15:
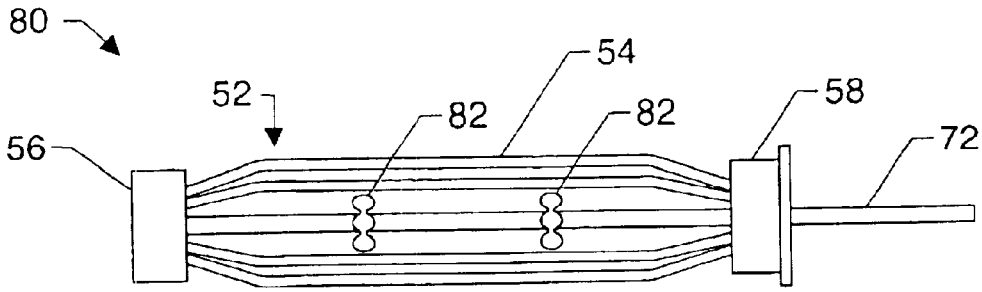
FIG. 15 is a side view of one embodiment of a combined stirring device and mounting device of the present invention that also functions as a holding device.
Figure 16:
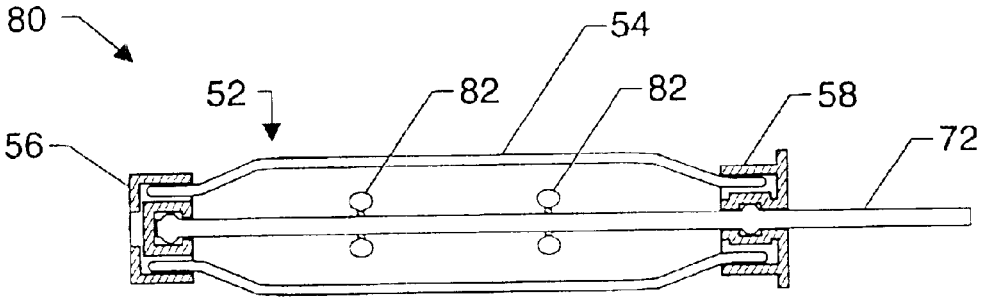
FIG. 16 is a sectional side view of the embodiment of the combined stirring device and mounting device as shown in FIG. 15.
Figure 17:
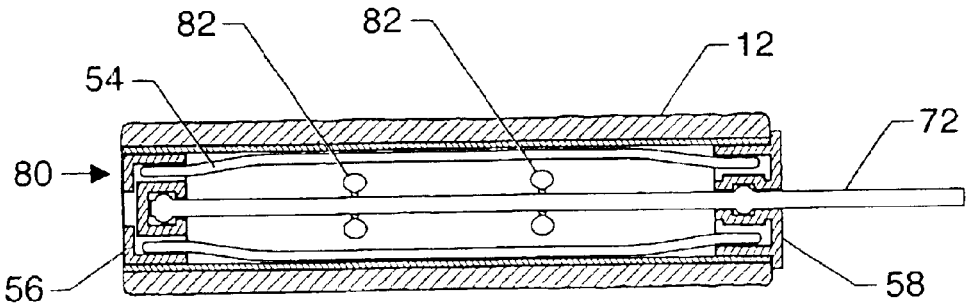
FIG. 17 is a sectional side view of the embodiment of the combined stirring device and mounting device as shown in FIG. 15 with a roller paint brush cover placed thereon.
Figure 18:
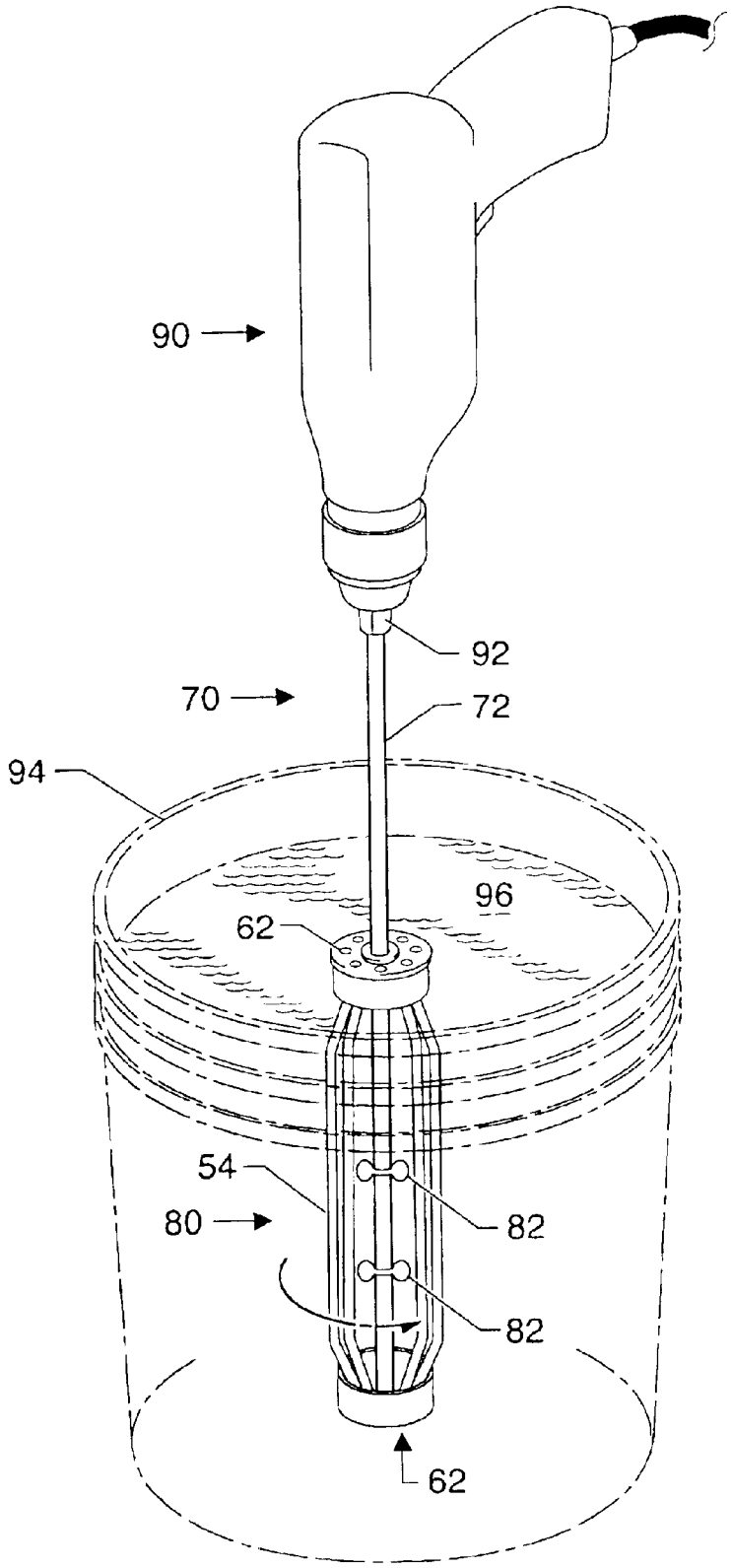
FIG. 18 illustrates the spinning of the stirring device of the present invention in a container of paint or other fluid.

The present invention is a device, method and system for cleaning paint and other liquid coatings and the like from paint roller brushes. FIGS. 1–6 illustrate a preferred embodiment of a method for using the devices and system of the present invention. FIGS. 7–12 illustrate preferred embodiments of the gripping device of the present invention. FIGS. 13 and 14 illustrate a preferred embodiment of a combined holding device and mounting device of the present invention. FIGS. 15–17 illustrate a preferred embodiment of a combined stirring device and mounting device of the present invention that can also function as a holding device. FIG. 18 illustrates a preferred embodiment of the operation of the stirring device of the present invention.

Referring now generally to the FIGS., the invention comprises a gripping device 30 for removing a paint roller brush 12 from the handle framework 14 of a painting device, a holding device 50 for holding the paint roller brush 12 during the paint removing and cleaning process, and a mounting device 70 for connecting the holding device 50 with the paint roller brush 12 to a motor or other motion imparting means 90. The invention further comprises a propeller device 92 attached to the holding device 50 for stirring and mixing paint.

Referring now to FIGS. 7–12, the gripping device 30 comprises a generally cylindrical tube 32 mounted on a handle 34. Handle 34 is for grasping by the user and can be any suitable shape, such as the exemplary pistol grip shape shown in the FIGS. The generally cylindrical tube 32 comprises two ends, insertion end 36 and tail end 38 and can comprise either a solid cylindrical wall 40 or preferably a cylindrical wall 40 having an open slot 42 along its length. Although the length of cylindrical tube 32 generally is unimportant, it preferably is no longer than the length of a typical roller paint brush cover 12, which is between approximately 2 inches (5 cm) and 9 inches (23 cm), depending on the size and type of roller paint brush cover 12 used. Thus, the cylindrical tube 32 can be made of many different lengths to accommodate many different lengths of roller paint brush covers 12. For the typical 9 inch (23 cm) roller paint brush cover 12, the cylindrical tube 32 more preferably no longer than 6 inches (15 cm), and even more preferably between 2 inches (5 cm) and 6 inches (15 cm) in length. A cylindrical tube 32 having a length of 2 inches (5 cm) can be used for most lengths of roller paint brush cover 12. Having a length shorter than the length of the roller paint brush cover can allow the user to pull the roller paint brush cover 12 out of the gripping device 30 if necessary.

The inner diameter of the generally cylindrical tube 32 preferably is approximately the same as or slightly smaller or larger than the outer diameter of the typical roller paint brush cover 12, including the nap, which is between approximately 1 inch (2.5 cm) and 3 inches (7.5 cm). Alternatively, the inner diameter of the generally cylindrical tube 32 can be relatively large, such as for illustrative purposes 3 inches (7.5 cm) or larger up to 4 inches (10 cm) or 5 inches (12.7 cm), so as to be able to accommodate different roller paint brush covers 12 having a wide variety of diameters. Having a diameter greater than the diameter of the roller paint brush cover 12 can prevent the roller paint brush cover 12 from becoming lodged in the gripping device 30. Similarly, having a diameter less than the diameter of the roller paint brush cover 12 can assist in retaining the roller paint brush cover 12 within the gripping device 30. Thus, gripping devices 30 of various diameters can be made for paint roller brushes 12 of various diameters, or a single gripping device 30 having a relatively large, or having a variable, diameter can be made for use with several different diameters of roller paint brush covers 12.

The open slot 42 can extend along the entire length of the generally cylindrical tube 32 to provide a passageway for a support rod 16 of the handle framework 14 to pass as the roller paint brush cover 12 and the gripping device 30 are moved to remove the roller paint brush cover 12 from the handle framework 14. As can be seen in the FIGS., a typical handle framework 14 comprises a metal or other material rod 16 bent to accommodate the roller paint brush cover 12. Rod 16 typically is on the order of ¼ inch (0.6 cm) to ⅝ inch (1.3 cm) in diameter or thickness. Therefore, to accommodate the majority of rods 16, open slot 42 preferably is between ¼ inch (0.6 cm) and ¾ inch (1.9 cm) wide, that is, from one edge of cylindrical tube 32 to the other edge. Further, as the open structure of cylindrical tube 32 due to slot 42 can cause cylindrical tube 32 to be somewhat flexible, that is cylindrical tube 32 and open up slightly to a larger diameter due to the presence of slot 42, the width of slot 42 itself can be increased by sliding rod 16 through it if the diameter of rod 16 is larger than the width of slot 42.

Figure 8:
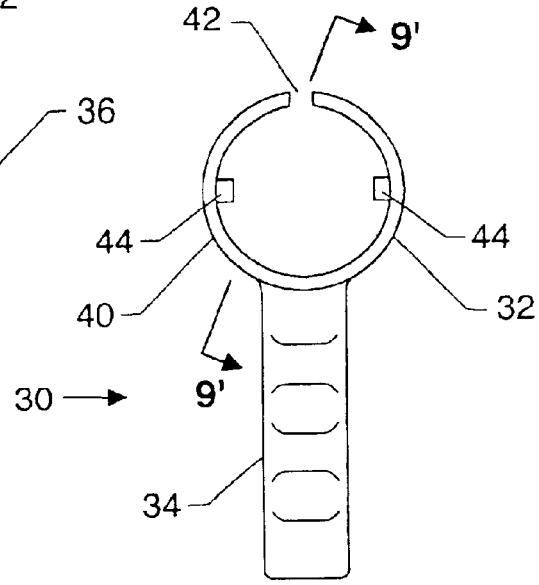
FIG. 8 is an end view of one embodiment of the gripping device of the present invention.
Figure 9:
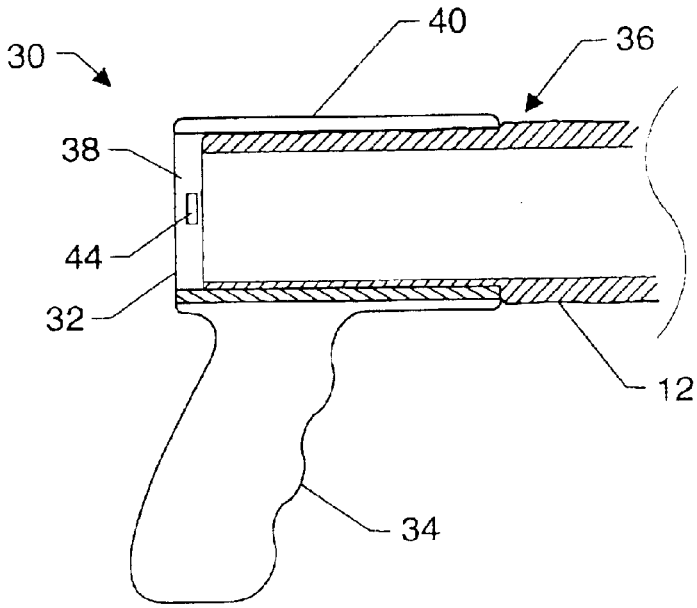
FIG. 9 is a sectional side view of the embodiment of the gripping device as shown along line 9'—9' of FIG. 8 with a roller paint brush cover inserted therein.
Figure 11:
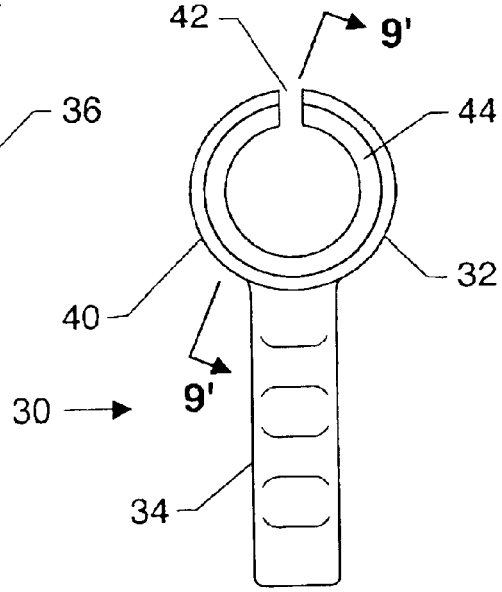
FIG. 11 is an end view of another embodiment of the gripping device of the present invention.
Figure 12:
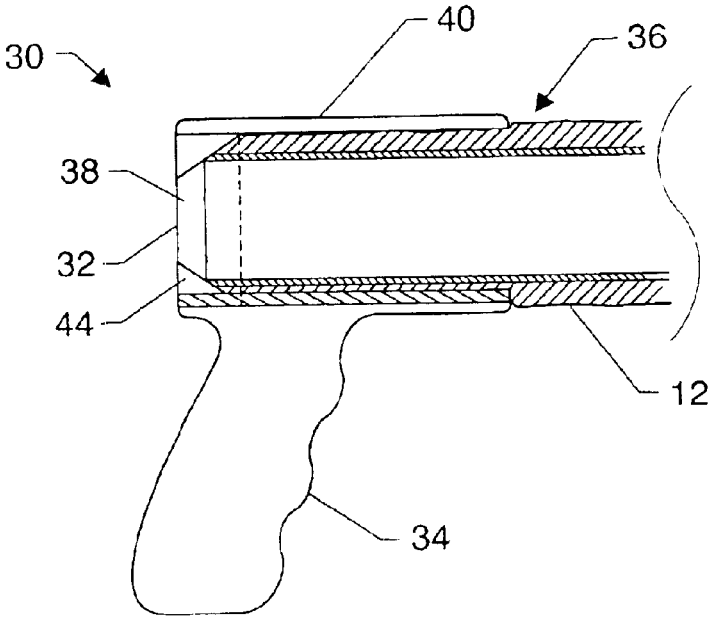
FIG. 12 is a sectional side view of the embodiment of the gripping device as shown along line 12'—12' of FIG. 11 with a roller paint brush cover inserted therein.

The insertion end 36 of the gripping device 30 preferably is completely open so as to allow the insertion of the roller paint brush cover 12. The tail end 38 can also be completely open, but optionally can be closed, partially closed, or comprise one or more stopping devices 44 for contacting and pushing the roller paint brush cover 12 off of the handle framework 14. As shown in FIG. 8, stopping devices 44 can be tabs 44A extending radially inwardly proximal to tail end 38. Preferably, tabs 44A extend inwardly from cylindrical tube 32 between approximately 3/16 inch (0.5 cm) and ½ inch (1.3 cm). As shown in FIG. 11, stopping device 44 can be a toroidal or doughnut shaped inwardly extending extension 44B of cylindrical tube 32, or a toroidal or doughnut shaped insert that is secured within cylindrical tube 32, proximal to or at tail end 38. The use of a toroidal or doughnut shaped stopping device 44 has some advantages in that the slope of the structure, such as for example having an increasing diameter from proximal to tail end 38 inward along cylindrical tube 32, generally matches the side slope of many roller paint brush covers 12 and provides a continuous touch point for the inner cylindrical tube of the typical roller paint brush cover 12. However, for illustrative purposes, the tail end 38 can be completely closed, be partially closed with a central or radial holes, a series of tabs, a grill or mesh, one or more radial or chordal slats extending across tail end 38, or a toroidal or doughnut shaped inwardly extending extension or insert secured within cylindrical tube 32, as stopping devices 44. For ease of cleaning, it is preferable for tail end 38 to have some open portion.

The handle 34 is attached to the generally cylindrical tube 32 along the cylindrical wall in such location allowing the user to hold the generally cylindrical tube 32 but not interfering with the ends 36, 38 of the generally cylindrical tube 32. As shown in the FIGS., handle 34 is located opposite slot 42 and proximal to tail end 38. However, handle 34 can be located at any position on the circumference and along the length of cylindrical tube 32. Further, handle 34 can be molded as part of cylindrical tube 32 or can be attached later, either permanently or releasably.

Figure 4:
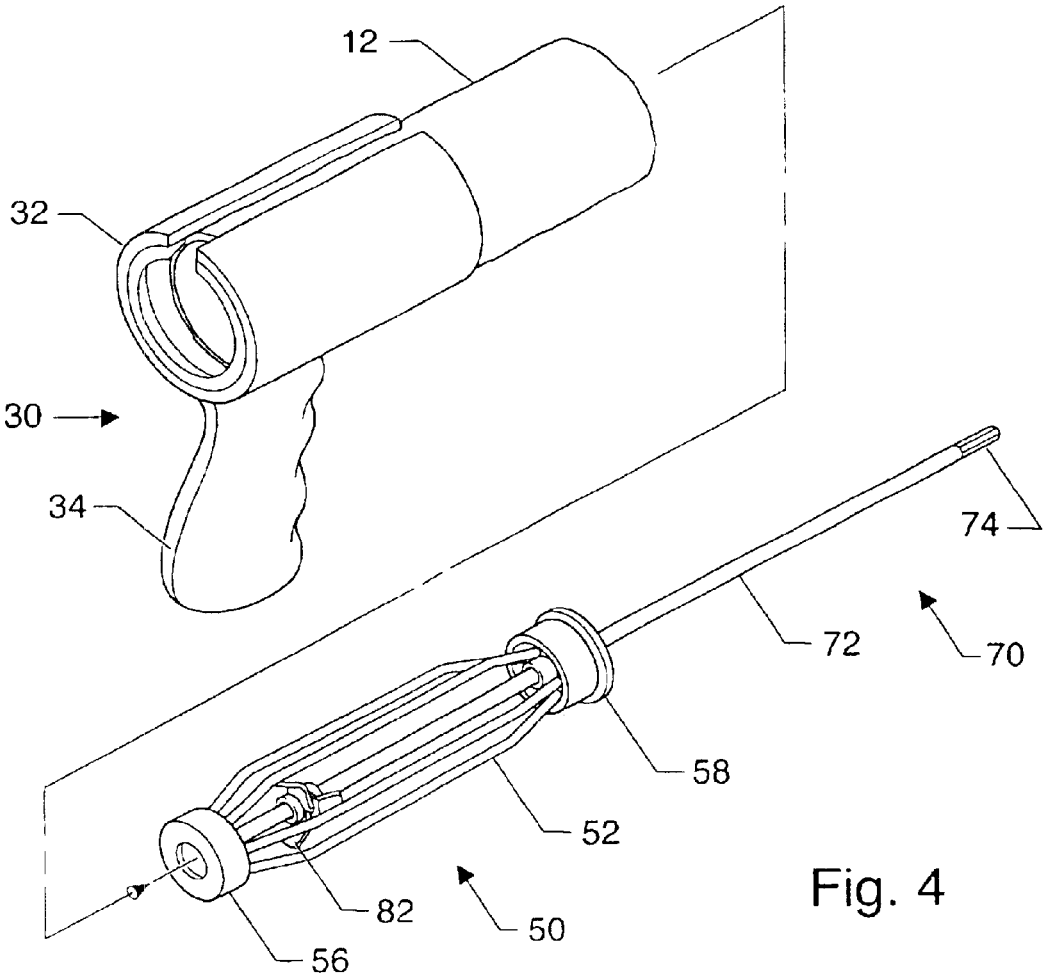
FIG. 4 illustrates the placement of the loaded roller paint brush cover onto the holding device of the present invention.
Figure 10:
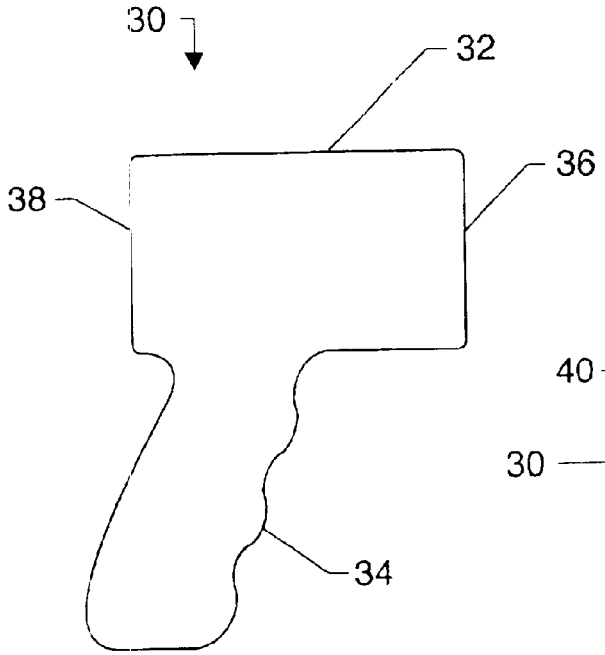
FIG. 10 is a side view of another embodiment of the gripping device of the present invention.

The holding device 50 as shown illustratively in FIGS. 4 and 10 comprises a cage-like frame 52 similar or identical to the known cage-like frames on which paint roller brushes are mounted for use during painting. Such cage-like frames 52 are known in the art and generally cylindrical in shape, the cylindrical shape being formed by a plurality of wires or rods 54 extending the length of the cylindrical shape. Optionally, the cage-like frame 52 can be replaced with a solid or perforated cylinder or the equivalent. End caps 56, 58 rings or other devices can be used to hold the plurality of wires or rods 54 together in the generally cylindrical shape, and can have flow holes 62 therethrough to allow liquid within the interior of roller paint brush cover 12 to flow out. The outer diameter of the holding device 50 preferably is approximately the same as the inner diameter of the paint roller brush 12 such that the paint roller brush 12 can be mounted and held securely on the holding device 50. Optionally, the holding device 50 can have an outer diameter slightly larger than the inner diameter of the paint roller brush 12, or can be a flexible or spring-like construction, to increase the holding power.

Many different sized holding devices 50 can be made to accommodate the various different sized roller paint brush covers 12. For example, roller paint brush covers 12 having inner diameters of 1 inch (2.5 cm) would require a holding device 50 with a similar outer diameter, while roller paint brush covers 12 having an inner diameter of 2 inches (5 cm) would require a holding device 50 with a similar larger outer diameter. Likewise, for example, roller paint brush covers 12 having a length of 3 inches (7.5 cm) would require a holding device 50 with a similar length, while roller paint brush covers 12 having a length of 9 inches (23 cm) would require a holding device 50 with a similar longer length. A holding device 50 having a length of 9 inches (23 cm) could accommodate a wide range of lengths of roller paint brush covers 12, including roller paint brush covers 12 having lengths longer and shorter than 9 inches (23 cm).

The mounting device 70 as shown illustratively in FIGS. 13 and 14 comprises a shaft or rod 72 that is attached securely to and extends axially from the holding device 50. The mounting device 70 can extend along the entire or partial length of the holding device 50, in which case it would be positioned as the central axis, or it can be attached at an end of the holding device 50 and extend outwardly and axially from the holding device 50. In any construction, the mounting device 70 extends a suitable distance outwardly and axially from the holding device 50 so as to mountable in the motor or other motion imparting device 90.

As can be seen in more detail in FIG. 14, mounting device 70 comprises shaft or rod 72 that extends from one end cap 56 of holding device 50 through a second end cap 58 of holding device 50, and then outward radially a certain distance from second end cap 58. The length of shaft or rod 72 extending outwardly from holding device 50 is such that it can be inserted securely into any mounting part of motor or other motion imparting device 90. For example, if motor or other motion imparting device 90 is a power drill, shaft or rod 72 preferably should be at least 1 inch (2.5 cm) so as to fit within power drill chuck 92. Preferably, shaft or rod 72 is between 2 inches (5 cm) and 10 inches (25 cm) in length, and more preferably between 6 inches (15 cm) and 9 inches (23 cm). It has been found that an 8 inch (20 cm) length provides a suitable compromise between allowing the user to maintain the invention at a suitable distance from the user to prevent splattering of paint and cleaning solution and allowing for a smooth rotation.

Figure 5:
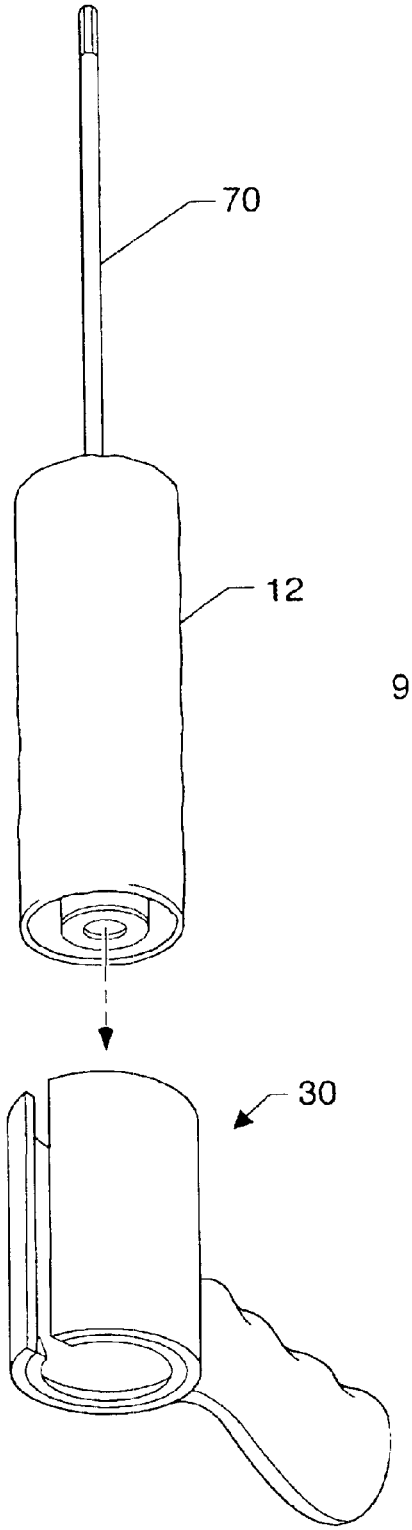
FIG. 5 illustrates the removal of the gripping device of the present invention from the loaded roller paint brush cover after the loaded roller paint brush cover has been placed on the holding device of the present invention.
Figure 6:
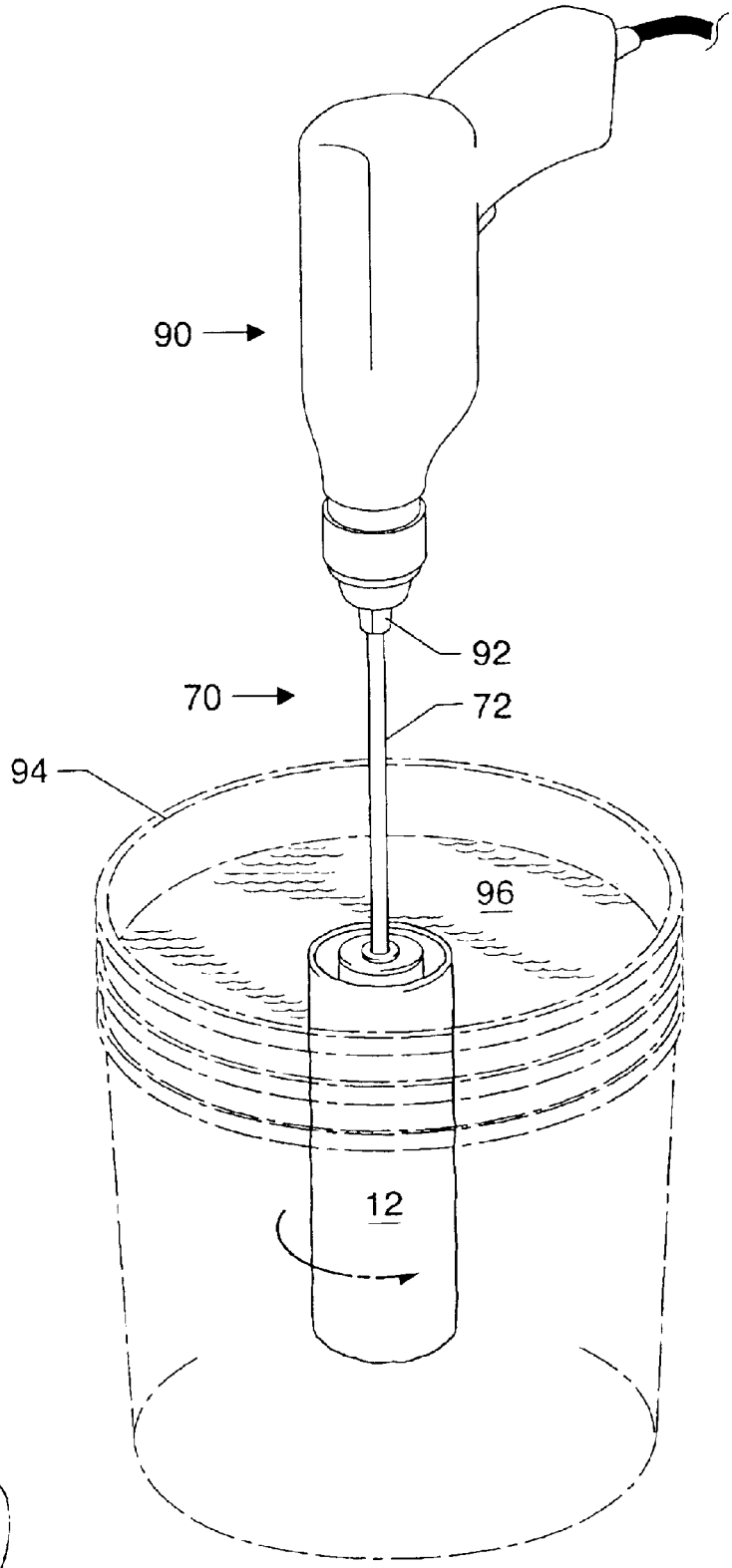
FIG. 6 illustrates the spinning of the loaded roller paint brush cover mounted on the holding device of the present invention in a bucket of water or other solvent or cleaning solution.
Figure 7:
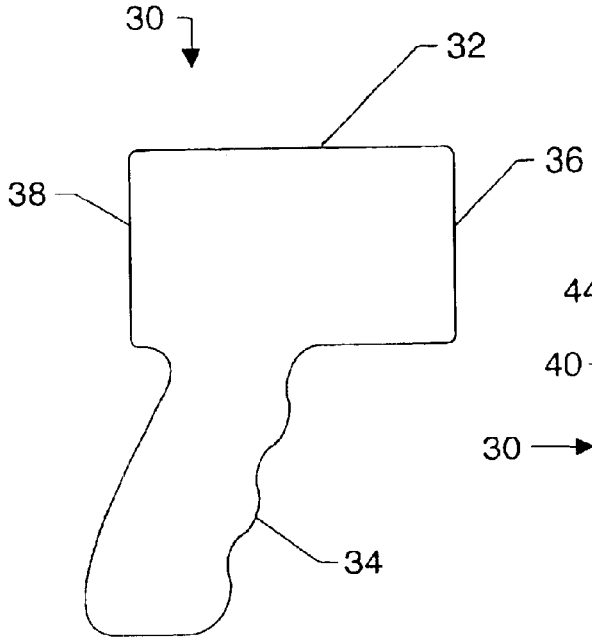
FIG. 7 is a side view of one embodiment of the gripping device of the present invention.

The end of the mounting device 70 distal from the holding device 50 can comprise a formed end 74 for secure mounting within the motor or other motion imparting device 90. For example, as shown in FIGS. 4, 5 and 13, formed end 74 is formed to complement the chuck of a power drill used as the motor or other motion imparting device 90. Such a formed end is optional, and can be custom formed for a particular motor or other motion imparting device 90 or type of motor or other motion imparting device 90, and can be used to assist in the rotational motion transfer from the motor or other motion imparting device to the mounting device 70.

The motor or other motion imparting device 90 preferably provides rotational motion to the mounting device 70, and thus to the holding device 50 and any paint roller brush 12 on the holding device 50. A hand or power drill, screwdriver, or other such motor-driven device is suitable.

Figure 1:
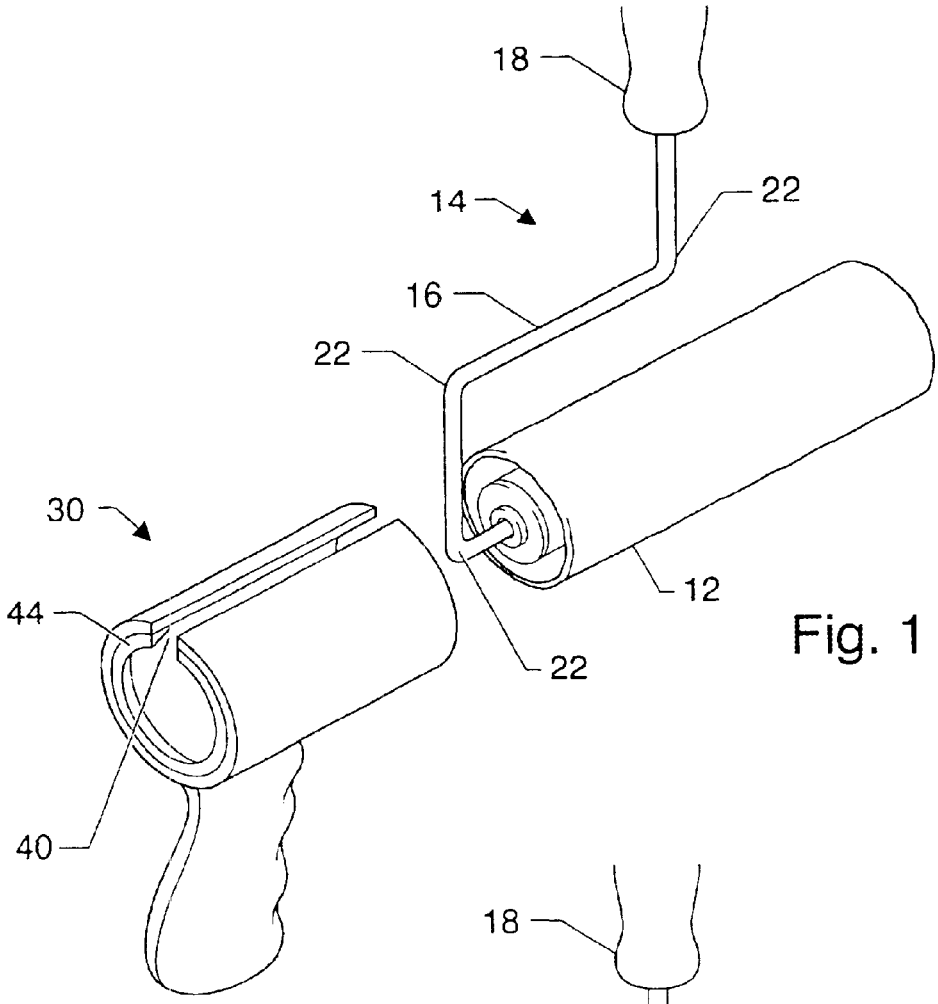
FIG. 1 illustrates the position of the gripping device of the present invention prior to being placed over a loaded roller paint brush cover on a typically handle framework.
Figure 2:
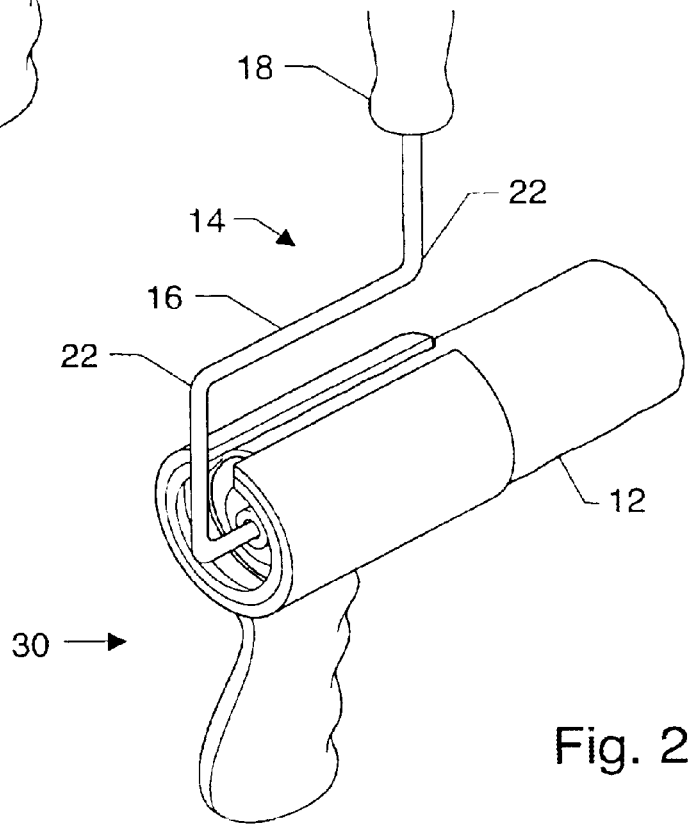
FIG. 2 illustrates the gripping device of the present invention being placed over a loaded roller paint brush cover.
Figure 3:
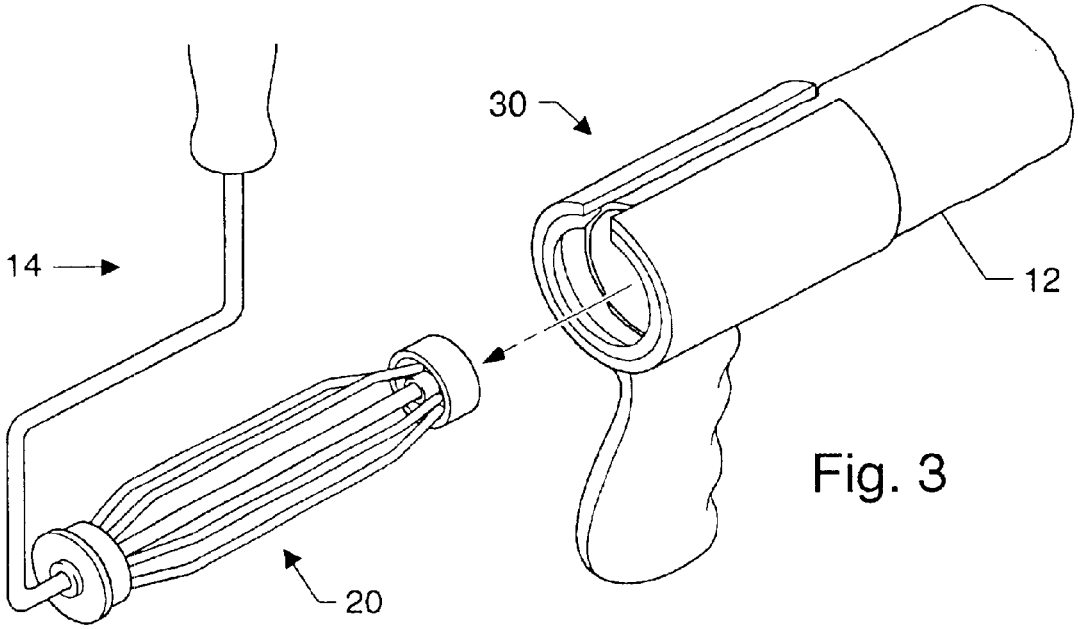
FIG. 3 illustrates the removal of a loaded roller paint brush cover from a typical handle framework using the gripping device of the present invention.

An illustrative use of the invention is shown in FIGS. 1–6. In use, a house, wall, ceiling or other structure or surface has been painted using a roller paint brush cover 12, the roller paint brush cover 12 generally remains loaded with some paint. Rather than removing the loaded roller paint brush cover 12 from the handle framework 14 with the hands, gloves or other means that would then become soiled and/or ruined, the user of the invention grasps the handle 34 of the gripping device 30 and slides the cylindrical tube 32 portion of the gripping device 30 over the loaded roller paint brush cover 12. Handle frameworks 14 typically have a singe shaped rod 16 extending from a handle 18 and terminating in a roller paint brush cover holding end 20 after bending through a series of curves 22, thus holding the roller paint brush cover 12 from one end. A typical representation of a handle framework 14 is shown in FIG. 1.

The griping device 30 is placed over the loaded roller paint brush cover 12 with the support rod 16 of the handle framework 14 passing through the slot 42 in the generally cylindrical tube 32. The user pushes the gripping device 30 over the loaded roller paint brush cover 12 until the roller paint brush cover 12 presses against stopping device 44 or other stopping means. The user then continues to push the loaded roller paint brush cover 12 off of the handle framework 14. If the gripping device 30 comprises a stopping device 44, this will assist in pushing the roller paint brush cover 12 off of the handle framework 14. Alternatively, the gripping device 30 can be structured to hold the roller paint brush cover 12 securely enough to remove the roller paint brush cover 12 from the handle framework 14 without the need for a closed or partially closed tail end 38, or a stopping device 44.

Once the loaded roller paint brush cover 12 is removed from the handle framework 14, the user then transfers the loaded roller paint brush cover 12 onto the holding device 50 in generally the opposite manner as the roller paint brush cover 12 was removed from the handle framework 14. The user slides the roller paint brush cover 12 onto the cage-like frame 52 or other structure of the holding device 50 and then removes the gripping device 30 by pulling it in the opposite direction, leaving the roller paint brush cover 12 on the holding device 50. The holding device 50 either already is mounted on or then is mounted on the motor or motion imparting device 90 in much the same way a drill bit is mounted in the chuck of a power drill.

The loaded roller paint brush cover 12 then can be placed in an empty bucket and the motor or other motion imparting device 90 activated to spin the roller paint brush cover 12. This optional first spin helps remove any extraneous paint from the roller paint brush cover prior to cleaning in the cleaning solution 96. The roller paint brush cover then is placed into a bucket or other container 94 of water or soapy water (for water soluble paints) or other solvent (for water insoluble paints), generally referred to as a cleaning solution 96, and the motor or other motion imparting device 90 activated. The roller paint brush cover 12 is spun around in the cleaning solution 96 for a period of time sufficient to remove the paint from the roller paint brush cover 12. This step can be repeated any number of times to achieve the level of cleaning desired. The roller paint brush cover 12 then can be spun in a bucket of clean water to rinse cleaning solution 96 from the roller paint brush cover 12. After the roller paint brush cover 12 has been cleaned, the roller paint brush cover 12 then can be spun in an empty bucket, cylinder or other structure, or in the open, to remove any excess water or cleaning solution 96 and to spin dry the roller paint brush cover 12. The roller paint brush cover 12 now has been restored to a clean or cleaner state for reuse.

As shown in FIGS. 4 and 15–17, the invention further includes a stirring device 80 for stirring and/or mixing paints, stains and other coatings and liquids. The stirring device 80 is a modification of the holding device 50 and comprises a cage-like frame 52 similar or identical to the known cage-like frames on which paint roller brushes are mounted for use. The cage-like frame 52 generally is cylindrical in shape, the cylindrical shape being formed by a plurality of wires or rods 54 extending the length of the cylindrical shape. End caps 56, 58, rings or other devices can be used to hold the plurality of wires or rods 54 together in the generally cylindrical shape. The stirring device 80 also has rod 72 as the central axis, which generally is a continuation of the shaft or rod 72 of the mounting device 70. The central axis can be the portion of shaft or rod 72 or a separate component. The stirring device further comprise one or more stirring or mixing means 82, which can be one or more impellers or any other suitable mixing component, mounted on shaft or rod 72.

An illustrative use of the stirring device 80 is shown in FIG. 18. The stirring device 80 is mounted via the mounting device 70 on a motor or other motion imparting device 90 and the stirring device 80 is placed in the liquid 96 to be stirred or mixed. The motor or other motion imparting device 90 is activated and the stirring device 80 acts on the liquid 96. Specifically, the stirring or mixing means 82, through the rotary motion, causes the liquid 96 to circulate about the container 94, thus stirring and/or mixing the liquid 96. The cage-like frame 52 also can assist in stirring and/or mixing the liquid 96, and further allows stirring and/or mixing right up to the side of the container 94 as the cage-like frame 52 can contact the container 94 without damaging the container 94 or causing the stirring or mixing means 82 to be damaged.

The above description sets forth the best mode of the invention as known to the inventor at this time, and is for illustrative purposes only, as one skilled in the art will be able to make modifications to this process without departing from the spirit and scope of the invention and its equivalents as set forth in the appended claims.

What is claimed is:

1. A device for mixing and stirring paint, comprising:

a. an axial shaft;

b. at least one impeller mounted on said axial shaft, said impeller being for mixing and stirring the paint; and c. a cage-like frame surrounding said at least one impeller and surrounding at least a portion of said axial shaft, said cage-like frame being generally cylindrical in shape and having an outer diameter approximately the same as an inner diameter of a roller paint brush cover, wherein at least another portion of said axial shaft not surrounded by said cage-like frame extends outwardly from said cage-like frame for cooperating with a powered drill.

2. The device as claimed in claim 1, comprising two impellers mounted on said axial shaft, wherein said cage-like frame surrounds both impellers.

3. The device as claimed in claim 2, wherein the two impellers are spaced apart from each other on said axial shaft within said cage-like frame.

4. The device as claimed in claim 1, wherein the cage-like frame is constructed of a plurality of rods.

5. The device as claimed in claim 4, wherein the plurality of rods are arranged in a three-dimensional configuration and are equidistant from each other about the three-dimensional configuration.

6. The device as claimed in claim 4, wherein the rods are rigid.

7. The device as claimed in claim 1, wherein the components of the device are made of materials that are submersible in paints and coatings.

8. A device for mixing and stirring a liquid, comprising:

a. an axial shaft;

b. at least two impellers mounted on said axial shaft, wherein the at least two impellers are spaced apart from each other, said at least two impellers being for mixing and stirring the paint; and c. a cage-like frame surrounding said at east two impellers and surrounding at least a portion of said axial shaft, wherein the cage-like frame is constructed of a plurality of rods arranged in a three-dimensional configuration and are equidistant from each other about the three-dimensional configuration, said cage-like frame being generally cylindrical in shape and having an outer diameter approximately the same as an inner diameter of a roller paint brush cover, wherein at least another portion of said axial shaft not surrounded by said cage-like frame extends outwardly from said cage-like frame for cooperating with a powered drill.

9. The device as claimed in claim 8, wherein the rods are rigid.

10. The device as claimed in claim 8, wherein the components of the device are made of materials that are submersible in paints and coatings.

11. A combination device for mixing and stirring paint and holding a roller paint brush cover, comprising:

a. an axial shaft;

b. at least one impeller mounted on said axial shaft, said at least one impeller being for mixing and stirring the paint; and c. a generally cylindrical cage-like frame surrounding said at least one impeller and surrounding at least a portion of said axial shaft and said cage-like frame has an outer diameter in part at least as large as an inner diameter of the roller paint brush cover, wherein at least another portion of said axial shaft not surrounded by said cage-like frame extends outwardly from said cage-like frame for cooperating with a motion imparting device.

12. The device as claimed in claim 11, comprising two impellers mounted on said axial shaft, wherein said cage-like frame surrounding both impellers.

13. The device as claimed in claim 12, wherein the two impellers are spaced apart from each other on said axial shaft within said cage-like frame.

14. The device as claimed in claim 11, wherein the cage-like frame is constructed of a plurality of rods.

15. The device as claimed in claim 14, wherein the plurality of rods are arranged in a three-dimensional configuration and are equidistant from each other about the three-dimensional configuration.

16. The device as claimed in claim 15, wherein the cage-like frame further comprises an end cap having a flow hole therethrough allowing fluid communication between the interior of the roller paint blush cover and the ambient when a roller paint brush cover is being held on the cage-like frame.

17. The device as claimed in claim 11, wherein the components of the device are made of materials that are submersible in paints and coatings.

18. The device as claimed in claim 11, wherein the cage-like frame is structured to hold the roller paint brush cover in place while spin cleaning the roller paint brush cover.

19. The device as claimed in claim 11, wherein the motion imparting device is a powered drill.

20. The device as claimed in claim 11, wherein the motion imparting device is a powered drill.

21. A combination device for mixing and stirring paint and holding a roller paint brush cover, comprising:

a. an axial shaft;

b. at least two impellers mounted on said axial shaft, wherein the two impellers are spaced apart from each other; and c. a cage-like frame surrounding said at least two impellers and surrounding at least a portion of said axial shaft, wherein the cage-like frame is constructed of a plurality of rods arranged in a three-dimensional configuration and are equidistant from each other about the three-dimensional configuration and said cage-like frame has an outer diameter in part at least as large as an inner diameter of the roller paint brush cover, wherein at least another portion of said axial shaft not surrounded by said cage-like frame extends outwardly from said cage-like frame for cooperating with a powered drill.

22. The device as claimed in claim 21, wherein the cage-like frame further comprises an end cap having a flow hole therethrough allowing fluid communication between the interior of the roller paint brush cover and the ambient when a roller paint brush cover is being held on the cage-like frame.

23. The device as claimed in claim 21, wherein the components of the device are made of materials that are submersible in paints and coatings.

24. The device as claimed in claim 21, wherein the cage-like frame is structured to hold the roller paint brush cover in place while spin cleaning the roller paint brush cover.

25. A combination device for mixing and stirring paint and holding a roller paint brush cover, comprising:

a. an axial shaft;

b. at least one impeller mounted on said axial shaft, said at least one impeller being for mixing and stirring the paint; and c. a generally cylindrical cage-like frame surrounding said at least one impeller and surrounding at least a portion of said axial shaft and said cage-like frame has an outer diameter in part at least as large as an inner diameter of the roller paint brush cover, the cage-like frame comprising an end cap having a flow hole therethrough allowing fluid communication between the interior of the roller paint brush cover and the ambient when a roller paint brush cover is being held on the cage-like frame, wherein at least another portion of said axial shaft not surrounded by said cage-like frame extends outwardly from said cage-like frame for cooperating with a motion imparting device, and wherein the cage-like frame is structured to hold the roller paint brush cover in place while spin cleaning the roller paint brush cover.

26. The device as claimed in claim 25, comprising two impellers mounted on said axial shaft, wherein said cage-like frame surrounding both impellers.

27. The device as claimed in claim 26, wherein the two impellers are spaced apart from each other on said axial shaft within said cage-like frame.

28. The device as claimed in claim 25, wherein the cage-like frame is constructed of a plurality of rods arranged in a three-dimensional configuration and are equidistant from each other about the three-dimensional configuration.

29. The device as claimed in claim 25, wherein the components of the device are made of materials that are submersible in paints and coatings.

* * * * *